US011206902B2

(12) United States Patent
Surana

(10) Patent No.: US 11,206,902 B2
(45) Date of Patent: Dec. 28, 2021

(54) EARRING SET

(71) Applicant: Girshkumar Hirachand Surana, Hunghom (HK)

(72) Inventor: Girshkumar Hirachand Surana, Hunghom (HK)

(73) Assignee: Surana Brothers IP Holdings Limited, Hunghom (HK)

( * ) Notice: Subject to any disclaimer, the term of this patent is extended or adjusted under 35 U.S.C. 154(b) by 0 days.

(21) Appl. No.: 16/389,967

(22) Filed: Apr. 21, 2019

(65) Prior Publication Data

US 2020/0237059 A1 Jul. 30, 2020

(30) Foreign Application Priority Data

Jan. 29, 2019 (CN) ..... 201920157802.1
Jan. 31, 2019 (HK) ..... 19101828.5

(51) Int. Cl.
*A44C 7/00* (2006.01)

(52) U.S. Cl.
CPC ..... *A44C 7/00* (2013.01)

(58) Field of Classification Search
CPC ..... A44C 7/00; A44C 7/001; A44C 7/002; A44C 7/003; A44C 7/006
USPC ..... 63/12, 13, 14.4, 14.5; D11/87, 88, 40, D11/42, 43
See application file for complete search history.

(56) References Cited

U.S. PATENT DOCUMENTS 271,121 A * 1/1883 Riley et al. ..... A44C 7/00 63/12
4,700,552 A * 10/1987 Haley ..... A44C 7/006 63/12
5,816,073 A * 10/1998 Bardisbanyan ..... A44C 7/00 63/12
D420,934 S * 2/2000 Montaquila ..... D11/88
6,125,657 A * 10/2000 Esposito ..... A44C 7/00 24/598.2
6,843,072 B1 * 1/2005 Lau ..... A44C 7/00 24/629
D631,385 S * 1/2011 Lebail ..... D11/43
D878,236 S * 3/2020 Tashjian ..... D11/42
2013/0276477 A1 * 10/2013 Huynh ..... A44C 7/003 63/12
2013/0276478 A1 * 10/2013 Huynh ..... A44C 5/00 63/12
2019/0090598 A1 * 3/2019 Aaron ..... A44C 7/006

* cited by examiner

*Primary Examiner* — Jack W Lavinder
(74) *Attorney, Agent, or Firm* — Minta Law Group LC

(57) ABSTRACT

An earring set consisting of a primary and a secondary main body. One end of the primary main body can rotate towards the secondary main body. The other end (of the primary main body) has a fixed ear support, while one end of the secondary main body has a fixed vertical ear pin. The pin can go through the ear support and lock up into a fixed position.

10 Claims, 3 Drawing Sheets

EARRING SET

CROSS-REFERENCE TO RELATED APPLICATION

This patent application claims priority to Chinese Patent Application 201930050979.7 filed on Jan. 29, 2019, now pending and Hong Kong Patent Application No. 19101828.5 filed on Jan. 31, 2019, now pending.

BACKGROUND OF THE INVENTION

1. Field of the Invention

The field of the invention relates to earrings worn on an ear of a person.

2. Background

The earring alternatively called an ear pendant is an ornament worn on the ears and has become a necessary adornment for modern women. Many types of earrings are attached to the ear by piercing through a hole on the tragus. However, the pin going through the tragus is not always secure and as a result, the earring can easily fall off. In other instances, the locking mechanism on the earring is not always easy for the user to operate, resulting in the earring falling off and being lost. Therefore, there is a need for an improved device to provide a type of earring that locks firmly and does not easily fall off.

SUMMARY OF THE INVENTION

The present invention is an earring set consisting of a primary and a secondary main body. One end of the primary main body can rotate towards the secondary main body. The other end of the primary main body has a fixed ear support, while one end of the secondary main body has a fixed vertical ear pin. The pin can go through the ear support and lock up into a fixed position.

In addition, one end of the secondary main body has a raised area, while the primary main body has, on its far end apart from the one end with an ear support, a protrusion that matches the raised area to enable rotating of the primary main body on its rotation shaft. In addition, the locking is performed with a protrusion on the ear pin. There is an opening on the ear support that allows the pin to go through it, while the protrusion will lock on the opening.

In one embodiment, the shape of the protrusion is U-shaped. The ear pin is in the shape of a round shaft. The pin has a protrusion on both sides of its far end from the secondary main body of the earring. In an alternative embodiment, the shape of the protrusions is V-shaped. Alternatively, there can be one protrusion on the ear pin and it can be either U-shaped or V-shaped.

The secondary main body of the earring is V-shaped.

In addition, the ear pin is collinear with the central axis of the opening. The primary main body and the ear support are formed together through integrated molding.

In addition, the primary and secondary main body are made essentially of metal, which is karat gold.

The present invention provides the following advantages over the existing technologies. The locking of the earring is performed with a protrusion on an ear pin. There is an opening on an ear support that allows the pin to go through it and be locked in place. In this way, the earring locks firmly and does not easily fall off. The primary main body can rotate against the secondary main body and therefore enables the user to conveniently unlock the protrusion from the opening. The present invention is convenient and easy to operate.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
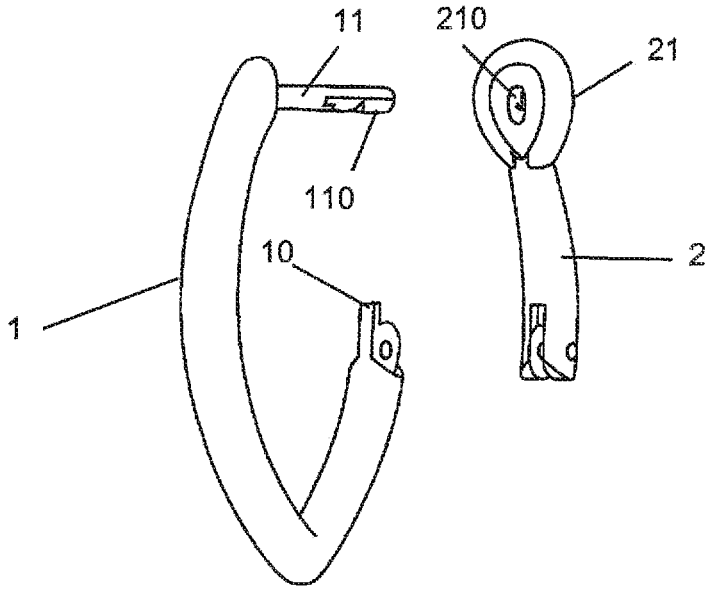
FIG. 1 is an exploded side view of the earring in the present invention.
Figure 2:
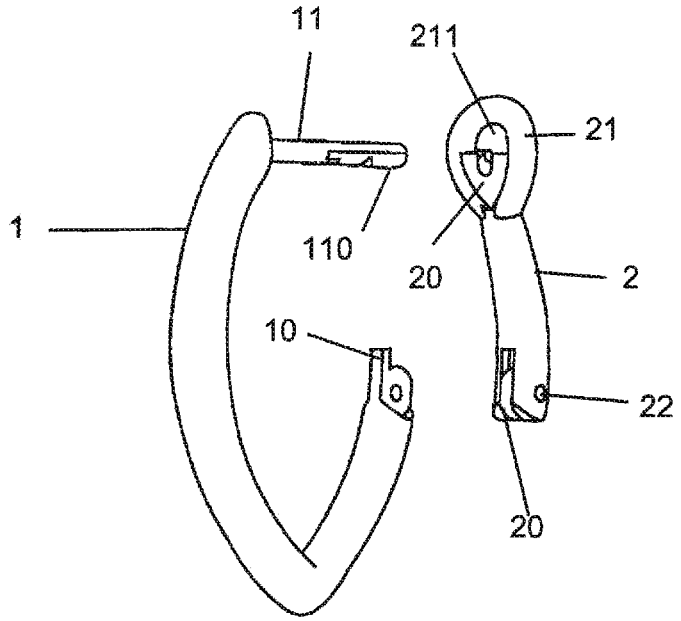
FIG. 2 is an exploded view of the earring in the present invention.
Figure 3:
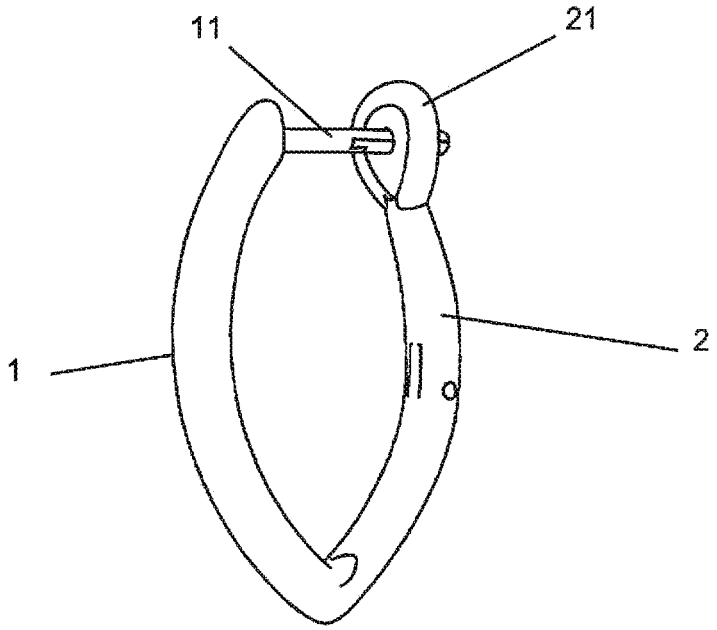
FIG. 3 is a first side perspective view of the present invention in the locked condition.
Figure 4:
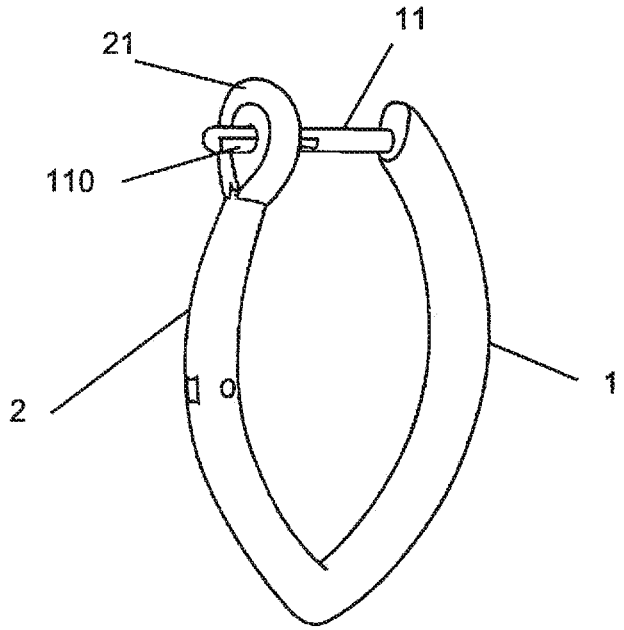
FIG. 4 is a second side view opposite to the view in FIG. 3 of the present invention in the locked condition.
Figure 5:
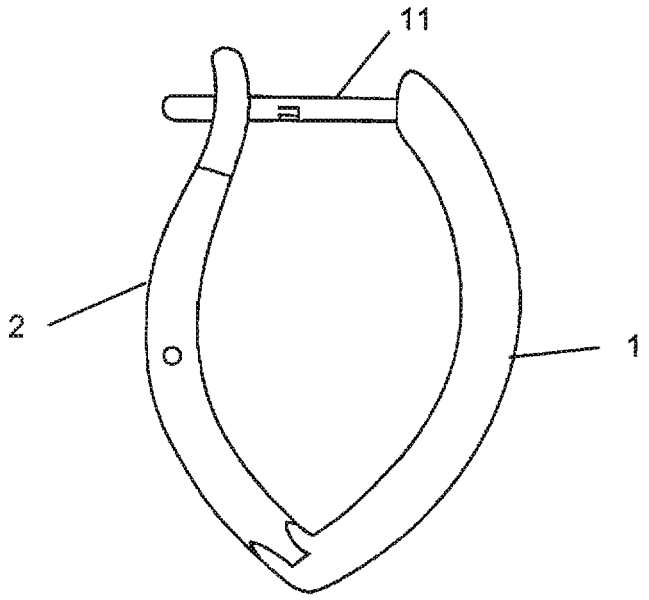
FIG. 5 is a side view of the present invention in the locked condition.

Referring to FIGS. 1-5, there is illustrated an earring set consisting of a primary main body 2 and a secondary main body 1. One end of the primary main body 2 can rotate towards the secondary main body 1. The other end of the primary main body 2 has a fixed ear support 21, while one end of the secondary main body 1 has a fixed vertical ear pin 11. The pin 11 can go through the ear support 21 and lock up. The locking is performed with a protrusion 110 on the ear pin 11. There is an opening on the ear support 21 that allows the pin 11 to go through it, while the protrusion 110 locks on the opening. In this way, the ear support is prevented from sliding forward or backward and the user can lock the earring firmly in place when wearing the earring. The ear support is an auxiliary part that is generally used on jewelry to affix ear studs by placing it on the back of the ear. When wearing an earring, the ear support 21 affixes the ear pin 11 from behind the ear after the pin 11 goes through the ear. One end of the secondary main body 1 has a raised area 10, while the primary main body 2 has, on its far end apart from the one end with an ear support 21, a protrusion 20 that matches the raised area 10 to enable rotation of the primary main body 2 on its rotation shaft 22. In this way, a user can unlock the mechanism. When the user intends to wear the earring, a locking can be performed by moving the ear pin 11 through the opening on ear support 21. The protrusion 110 on ear pin 11 locks into the opening on ear support 21. The opening can either be the oval opening 210 as shown in FIG. 1, or the semicircle opening 211 as shown in FIG. 2. When an unlocking is needed, the user can simply press the ear support 21 once in the downward direction, and the protrusion on the ear pin 11 will detach from the opening on the ear support 21. The user can then rotate the primary main body 2 away from the ear to unlock the earring. It is important to note that the ear support 21 is made of karat gold, an alloy of gold with other metals, and therefore has a certain elasticity.

In the present invention, in order to prevent the primary main body 2 from becoming less stable during the rotation, the protrusion 20 is U-shaped. The raised area 10 moves in the direction of the secondary main body 1. In addition, the primary main body 2 and the ear support 21 are formed together through integrated molding. Therefore, when ear support 21 is locked at a certain position, the rising area 10 which moves in the direction of the secondary main body 1 will restrict the primary main body 2 from moving forward.

In the present invention, in order to facilitate the process of the ear pin 11 being inserted through the opening of the ear support, the ear pin 11 is collinear with the central axis of the opening. In addition, the ear pin is in the shape of a round shaft. The pin has a protrusion on either or both sides of its far end from the secondary main body of the earring. The protrusion is positioned to facilitate the pin's insertion through the ear support. The shape of the protrusion is selected from the group consisting of U-shaped and V-shaped.

In the present invention, in order to lock up the ear support 21 more securely, the protrusion is V-shaped. The secondary main body of the earring is V-shaped and therefore, when viewed as a whole, the earring will appear more attractive.

In the present invention, the primary main body 2 and secondary main body 1 are metallic and the material is karat gold, a material that protects the earring from damage or wear and tear.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An earring comprising:

(a) a primary main body and a secondary main body;

(b) the secondary main body including a bottom end in the shape of a "V", a raised area extending up from one leg of the "V" shape bottom end, a transverse opening formed in the raised area, the secondary main body including an upper end retaining a fixed ear pin having a round shaft extending from the upper end of the secondary main body and including a protrusion formed on the round shaft of the ear pin on a far end from the upper end of the secondary main body;

(c) the primary main body including a bottom end having a protrusion receiving the raised area of the secondary main body with a matching opening with a pin connecting the matching opening of the primary main body to the transverse opening in the secondary main body to enable the primary main body to rotate towards and away from the secondary main body, a primary main body top end including a fixed ear support with a support opening;

(d) the fixed ear pin having the round shaft with the protrusion formed on the far end from the upper end of the secondary main body aligned with the support opening; and (e) the fixed ear pin and the support opening including means to lock the fixed ear pin through the protrusion formed on the far end of the round shaft into the fixed ear support, wherein pressing the fixed ear support downward detaches the protrusion on the far end of the round shaft of the fixed ear pin from the fixed ear support.

2. The earring in accordance with claim 1, further comprising:

said support opening includes a central axis which is collinear with said ear pin.

3. The earring in accordance with claim 2, further comprising:

(a) said support opening having a shape selected from the group consisting of an oval opening and a semicircular opening; and (b) said ear pin passes through said support opening and said protrusion on the ear pin locks the ear pin to said opening of said support opening.

4. The earring in accordance with claim 2, wherein a single downward push on the support opening unlocks the ear pin from said support opening.

5. An earring comprising:

(a) a primary main body and a secondary main body;

(b) the secondary main body including a bottom end terminating in a raised area extending out therefrom and including a transverse opening formed in the raised area, the secondary main body including an upper end retaining a fixed round ear pin having a shaft extending from the upper end of the secondary main body and including a protrusion formed on the shaft of the fixed round ear pin on a far end from the upper end of the secondary main body;

(c) the primary main body including a bottom end having a "U" shaped protrusion receiving the raised area of the secondary main body and rotatably connected to said raised area;

(d) the primary main body including a top end having a fixed ear support with a support opening;

(e) the fixed round ear pin having the shaft with the protrusion formed on the far end from the upper end of the secondary main body aligned with the support opening; and (f) the fixed round ear pin and the support opening including means to lock the fixed round ear pin through the protrusion formed on the far end of the shaft into the fixed ear support, wherein pressing the fixed ear support downward detaches the protrusion on the far end of the shaft of the fixed round ear pin from the fixed ear support.

6. The earring in accordance with claim 5, further comprising:

said support opening includes a central axis which is collinear with said fixed round ear pin.

7. The earring in accordance with claim 6, further comprising:

(a) said support opening having a shape selected from the group consisting of an oval opening and a semi-circular opening; and (b) said fixed round ear pin passes through said support opening and said protrusion on the fixed round ear pin locks the fixed round ear pin to said opening of said support opening.

8. The earring in accordance with claim 7, wherein a single downward push on the support opening unlocks the fixed round ear pin from said support opening.

9. The earring in accordance with claim 7, further comprising: said fixed round ear pin includes two protrusions.

10. The earring in accordance with claim 5, further comprising the secondary main body is V-shaped.

* * * * *